US008561227B2

(12) United States Patent
Jenkins

(10) Patent No.: US 8,561,227 B2
(45) Date of Patent: Oct. 22, 2013

(54) CRIB ROCKER ASSEMBLY

(76) Inventor: Levaughn Jenkins, Powder Springs, GA (US)

( * ) Notice: Subject to any disclaimer, the term of this patent is extended or adjusted under 35 U.S.C. 154(b) by 550 days.

(21) Appl. No.: 12/695,413

(22) Filed: Jan. 28, 2010

(65) Prior Publication Data

US 2010/0186164 A1 Jul. 29, 2010

Related U.S. Application Data

(60) Provisional application No. 61/147,957, filed on Jan. 28, 2009.

(51) Int. Cl.
*A47D 9/02* (2006.01)
*A47D 9/04* (2006.01)

(52) U.S. Cl.
USPC ..... 5/109; 5/108

(58) Field of Classification Search
USPC ..... 5/108, 109
See application file for complete search history.

(56) References Cited

U.S. PATENT DOCUMENTS

| | | | | | |
|---|---|---|---|---|---|
| 2,552,223 | A * | 5/1951 | Seifts | 5/109 |
| 2,631,302 | A * | 3/1953 | Bryant | 5/109 |
| 3,378,859 | A | 4/1968 | Parker | |
| 3,668,721 | A * | 6/1972 | Jenkins | 5/109 |
| 3,802,003 | A * | 4/1974 | Laureti | 5/108 |
| 3,849,812 | A * | 11/1974 | Walsh | 5/108 |
| 3,886,608 | A * | 6/1975 | Casella | 5/108 |
| 4,419,777 | A | 12/1983 | Parker | |
| 5,303,433 | A * | 4/1994 | Jang | 5/109 |
| 5,673,445 | A * | 10/1997 | Suter | 5/108 |
| 7,814,587 | B2 * | 10/2010 | Thomas | 5/109 |
| 7,862,118 | B2 * | 1/2011 | Sims, Jr. | 5/108 |
| 7,971,885 | B2 * | 7/2011 | Sanders et al. | 5/109 |
| 2006/0207022 | A1 * | 9/2006 | Jenkins | 5/93.1 |
| 2009/0064410 | A1 * | 3/2009 | Cohen et al. | 5/109 |

* cited by examiner

*Primary Examiner* — Robert G Santos
*Assistant Examiner* — David E Sosnowski
(74) *Attorney, Agent, or Firm* — Crose Law LLC; Bradley D. Crose

(57) ABSTRACT

A crib support is disclosed that includes a frame assembly configured to receive releasably a crib and be releasably secured to the crib, and a rocking mechanism, disposed within the frame assembly, configured to provide a rocking motion, and configured to create the effect of a reciprocatory movement, which is soothing and comforting to a baby.

14 Claims, 14 Drawing Sheets

CRIB ROCKER ASSEMBLY

CROSS-REFERENCE TO RELATED APPLICATION(S)

The present non-provisional patent application claims the benefit of priority of U.S. Provisional Patent Application No. 61/147,957, which is entitled "CRIB ROCKER ASSEMBLY", which was filed on Jan. 28, 2009, and which is incorporated in full by reference herein.

FIELD OF THE INVENTION

The technology described herein relates generally to an apparatus, system, and associated methods for safely supporting and rocking a crib, bassinet, or the like. More specifically, this technology relates to an apparatus adapted for connection with the legs of a child's crib to create the effect of reciprocatory movement, which is soothing and comforting to a baby.

BACKGROUND OF THE INVENTION

It is well known that babies like to be rocked in a rhythmic pattern. For example, it is common for a parent or caregiver to rock a child to sleep in a rocking chair. After the child falls asleep, the parent or caregiver typically places the child in a crib, at which point the rocking motion ceases. Although such rocking movement is not necessary for a child to fall asleep, the reciprocatory movement can function as an anesthetic for the child if the child is sick, teething, or the like, or for any child who finds it difficult to sleep.

Additionally, many new parents enjoy spending time with their child by instinctively rocking the child in a gentle, back-and-forth motion. While hours spent rocking a child can be a special period of bonding for both the parent or caregiver and the child, there are those occasions where it is not always possible for the parent or caregiver to hold the child in this manner, e.g., other children may require attention, the parent or caregiver may need to rest, or the parent or caregiver may need to attend to other duties.

Furthermore, it is known that a child is likely to awaken when transferred from a rocking chair, or similar state, to a crib. The technology described herein provides a device, system, and associated methods by which a child can experience the effect of reciprocatory movement, which is soothing and comforting to a baby, even after transfer from a rocking chair to a crib.

BRIEF SUMMARY OF THE INVENTION

In various exemplary embodiments, the technology described herein provides a device, system, and associated methods to provide a reciprocatory movement to a crib, which is soothing and comforting to a baby.

In one exemplary embodiment, the technology described herein provides a crib support. The crib support includes a frame assembly configured to receive a crib and be releasably secured to the crib and a rocking mechanism, disposed within the frame assembly, configured to provide a rocking motion, and configured to create the effect of a reciprocatory movement, which is soothing and comforting to a baby.

The frame assembly configured to receive a crib and be releasably secured to the crib further includes a bottom pan and a top frame. The top frame is configured to be placed upon the bottom pan.

The top frame also includes a right side frame angle and a left side frame angle. The right side frame angle and the left side frame angle are configured to provide additional structural support to the frame assembly and to provide a surface upon which a pivot means exists to provide a rocking motion to the releasably secured crib.

The top frame further includes a first cross frame angle and a second cross frame angle. The first cross frame angle and the second cross frame angle are configured to provide additional structural support to the frame assembly and to stabilize the right side frame angle and the left side frame angle.

The top frame still further includes a first frame plate adjacent to the first cross frame angle and a second frame plate adjacent to the second cross frame angle. The first frame plate and the second frame plate are configured to provide additional structural support to the frame assembly and to stabilize the right side frame angle and the left side frame angle.

The top frame also includes a top cover configured to be secured to the top frame to conceal the rocking mechanism.

The bottom pan, top frame, right side frame angle, and left side frame angle further include a multiplicity of pivot holes configured to receive a pivot rod about which the assembly pivots to provide a rocking motion and create the effect of a reciprocatory movement on the crib.

The right side frame angle and left side frame angle further include a multiplicity of slots disposed within a top surface to receive and secure crib leg retainers in order to secure the legs of the crib.

The frame assembly configured to receive a crib and be releasably secured to the crib further includes a plurality of crib leg retainers disposed upon the frame assembly and configured to receive and secure the legs of the crib.

The rocking mechanism further includes a motor mount assembly and a pivot assembly. The motor mount assembly is configured to provide a rocking motion and create the effect of a reciprocatory movement on the crib about the pivot assembly.

The motor mount assembly further includes a motor mount bracket to attach the motor mount assembly to the bottom pan of the frame assembly, a motor mounted to the motor mount bracket, a crank disk attached to the motor, a link attached to the crank disk, and a clevis bracket attached to the link and configured for coupled to the top frame.

The crib support includes a power source coupled to the motor to provide power to the motor to provide a rocking motion and create the effect of a reciprocatory movement on the crib about the pivot assembly.

The pivot assembly includes a pivot rod and a multiplicity of securing elements to secure the pivot rod to the frame assembly.

In another exemplary embodiment, the technology described herein provides a motorized baby crib system. The motorized baby crib system includes a crib for a baby and a crib support having a frame assembly configured to receive the crib and be releasably secured to the crib and a rocking mechanism, disposed within the frame assembly, configured to provide a rocking motion, and configured to create the effect of a reciprocatory movement, which is soothing and comforting to a baby.

The motorized baby crib system also includes a multiplicity of crib leg retainers disposed upon the frame assembly and configured to receive and secure the legs of the crib.

The motorized baby crib system also includes a top cover configured to be secured to the top frame to conceal the rocking mechanism.

The frame assembly configured to receive a crib and be releasably secured to the crib further includes a bottom pan and a top frame having a right side frame angle, a left side frame angle, a first cross frame angle, a second cross frame angle, a first frame plate adjacent to the first cross frame angle, and a second frame plate adjacent to the second cross frame angle. The top frame is configured to be placed upon the bottom pan. The right side frame angle and the left side frame angle are configured to provide additional structural support to the frame assembly and to provide a surface upon which a pivot means exists to provide a rocking motion to the releasably secured crib. The first cross frame angle and the second cross frame angle are configured to provide additional structural support to the frame assembly and to stabilize the right side frame angle and the left side frame angle. The first frame plate and the second frame plate are configured to provide additional structural support to the frame assembly and to stabilize the right side frame angle and the left side frame angle.

The bottom pan, top frame, right side frame angle, and left side frame angle further include a multiplicity of pivot holes configured to receive a pivot rod about which the assembly pivots to provide a rocking motion and create the effect of a reciprocatory movement on the crib.

The right side frame angle and left side frame angle further include a multiplicity of slots disposed within a top surface to receive and secure crib leg retainers in order to secure the legs of the crib.

In yet another exemplary embodiment, the technology described herein provides a method to provide a rocking motion to a crib to create the effect of a reciprocatory movement, which is soothing and comforting to a baby. The method includes engaging a crib to a crib support comprising a frame assembly configured to receive a crib and be releasably secured to the crib; and a rocking mechanism, disposed within the frame assembly, configured to provide a rocking motion, and configured to create the effect of a reciprocatory movement, which is soothing and comforting to a baby and providing a rocking motion to the crib.

Advantageously, the device, system, and methods disclosed herein provide an apparatus for imparting gentle and soothing rocking motions to a crib without the need for manual rocking by the parent/caregiver of the child. The apparatus has the flexibility of being attached to a variety of commercially available cribs. The apparatus operates by a non-complex, low cost mechanism. The apparatus is safe, economical, simply constructed, and easily repaired. The apparatus provides a simple and readily assembled unit which will reciprocate a baby's crib.

An advantage of the technology described herein is that it provides a device which is capable of being readily connected to a crib and which will effect the required to-and-fro movement thereof without any attention of the parent whatsoever.

Another advantage of the technology described herein is that it provides an assembly for reciprocating a baby's crib which is a separate and self-contained unit apart from the crib.

Another advantage of the technology described herein is that it provides an assembly for reciprocating a baby's crib which can readily be assembled and positioned beneath a conventional crib by the user.

Another advantage of the technology described herein is that it provides a device for reciprocating a baby's crib which is simple in construction and easy and economical to manufacture and assemble.

Another advantage of the technology described herein is that it provides a motorized baby crib support which is very comfortable and which could easily induce a baby to sleep due to its smooth and gentle movement.

An advantage of the technology described herein is that it can be set to operate for a predetermined time so that the baby will be rocked to sleep gently without the necessity of having the parent/caregiver stand by the baby whereby the parent/caregiver can readily perform other tasks while the baby is being rocked to sleep.

Although the apparatus of this invention has been primarily designed to rock the babies of human beings, it is to also be considered to be within the scope of this invention to employ this apparatus to rock other animal babies.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology described herein. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
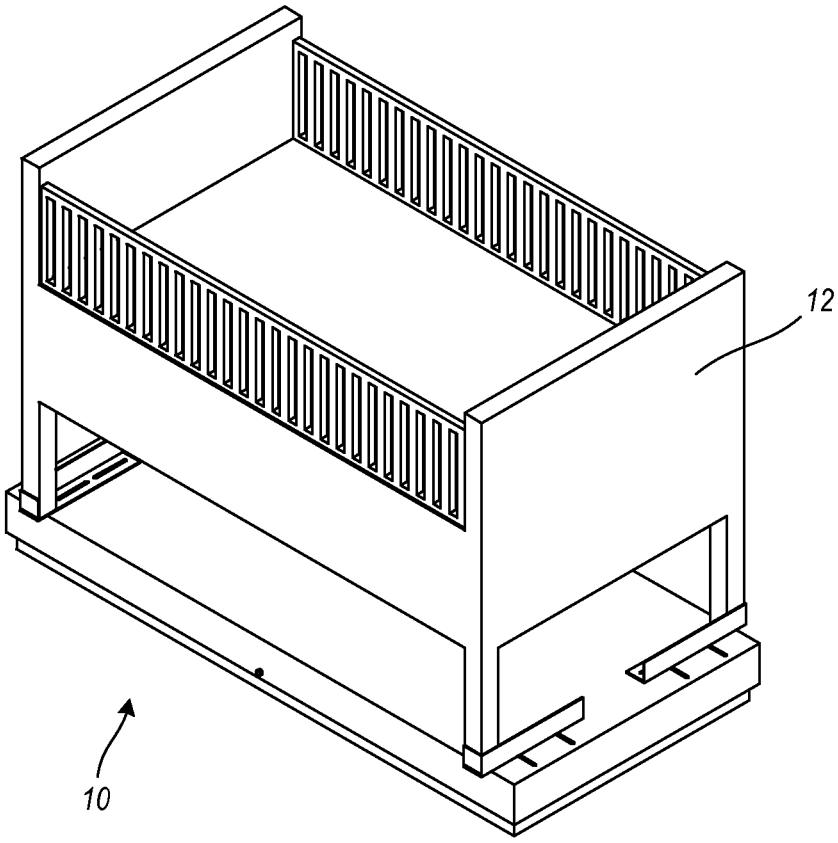
FIG. 1 is a front perspective view of a crib rocker assembly with a traditional infant crib secured thereon, according to an embodiment of the technology.
Figure 2:
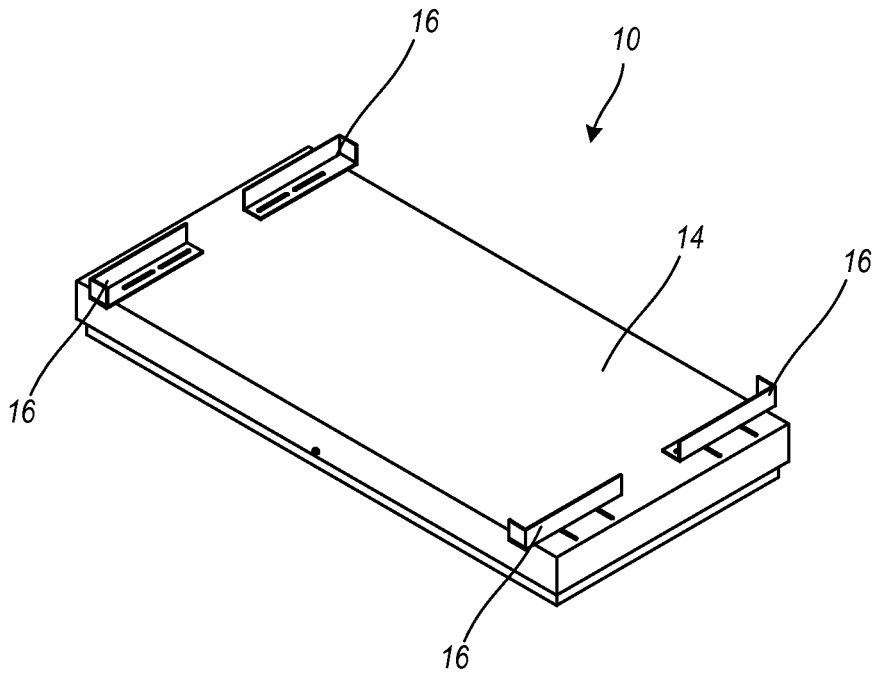
FIG. 2 is a front perspective view of the crib rocker assembly depicted in FIG. 1, illustrated with the traditional infant crib removed, and illustrating, in particular, the crib leg retention brackets installed thereon, according to an embodiment of the technology.
Figure 3:
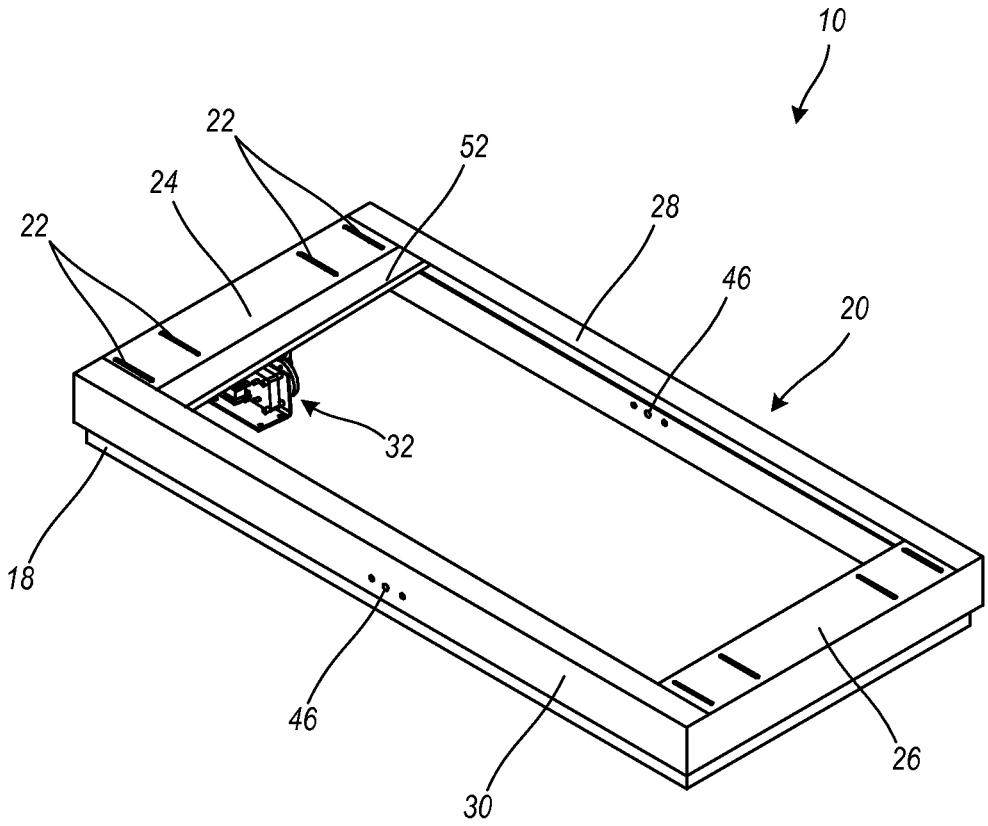
FIG. 3 is a front perspective view of the crib rocker assembly depicted in FIG. 2, illustrated with the cover removed.
Figure 4:
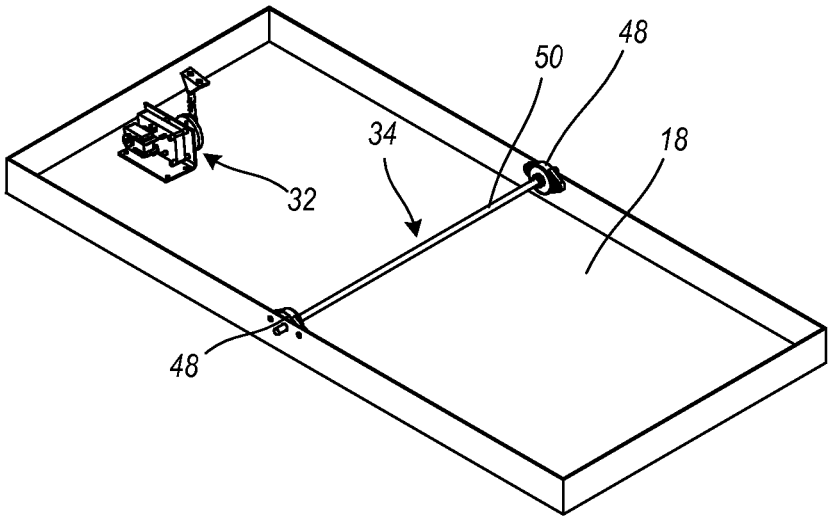
FIG. 4 is a front perspective view of the crib rocker assembly depicted in FIG. 3, illustrating, in particular, the bottom pan, pivot rod assembly, and installed motor assembly, according to an embodiment of the technology.
Figure 5:
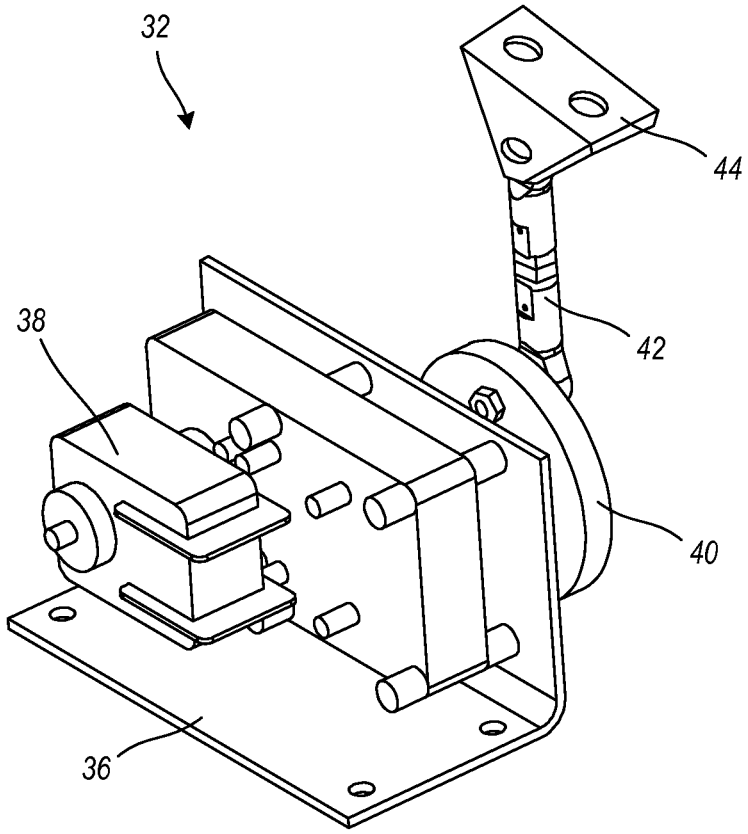
FIG. 5 is a front perspective view of a motor mount assembly, according to an embodiment of the technology.
Figure 6:
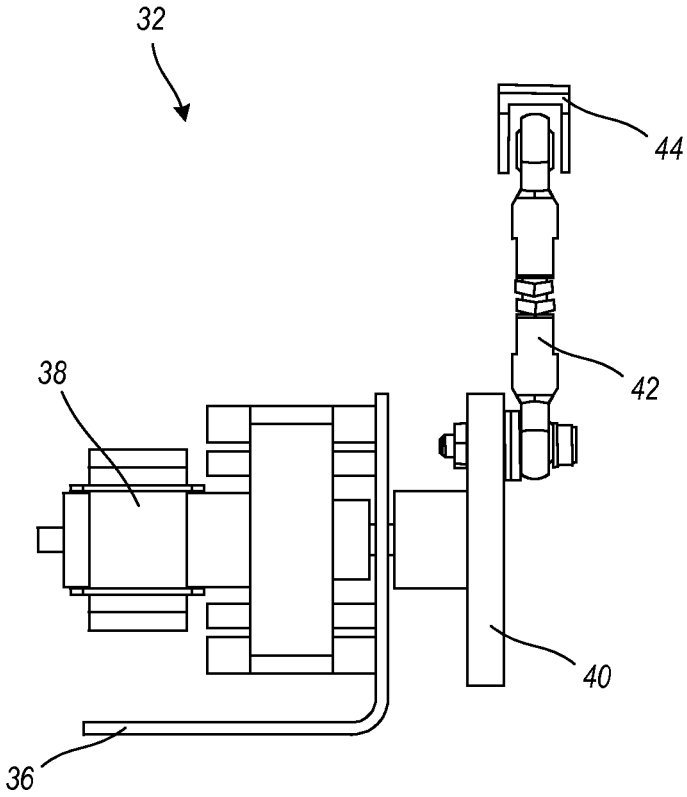
FIG. 6 is a front planar view of the motor mount assembly depicted in FIG. 5.
Figure 7:
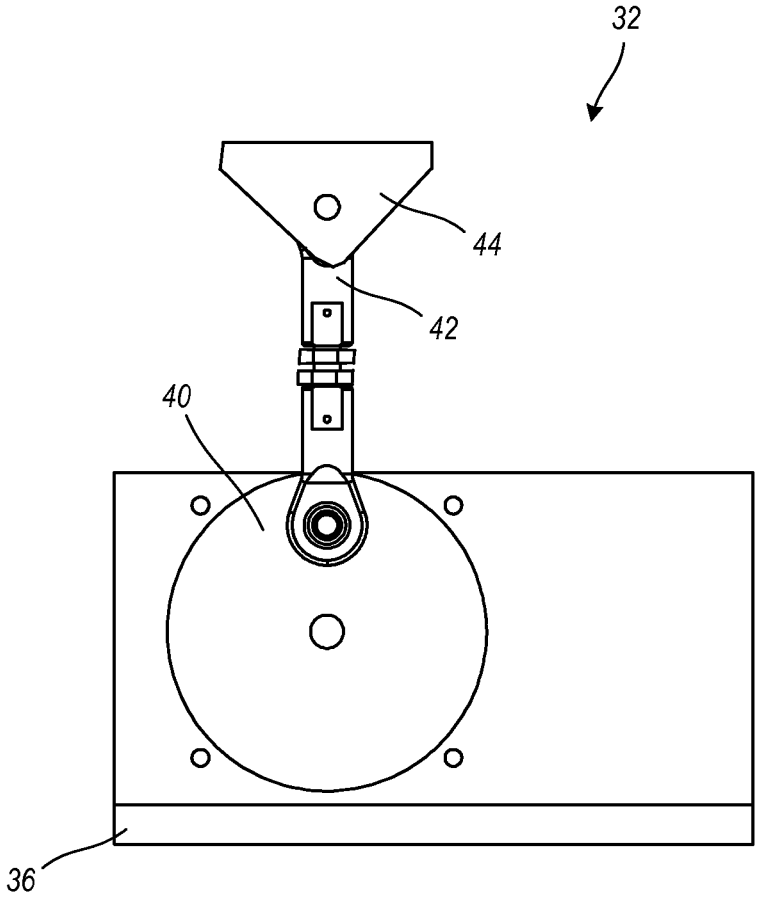
FIG. 7 is a left side planar view of the motor mount assembly depicted in FIG. 5.
Figure 8:
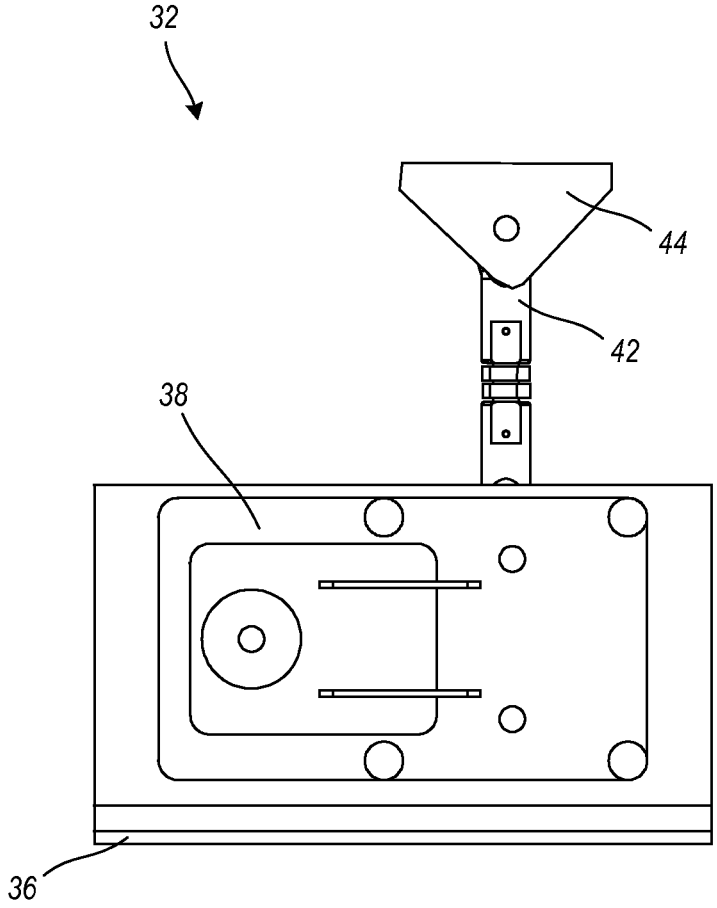
FIG. 8 is a right side planar view of the motor mount assembly depicted in FIG. 5.
Figure 9:
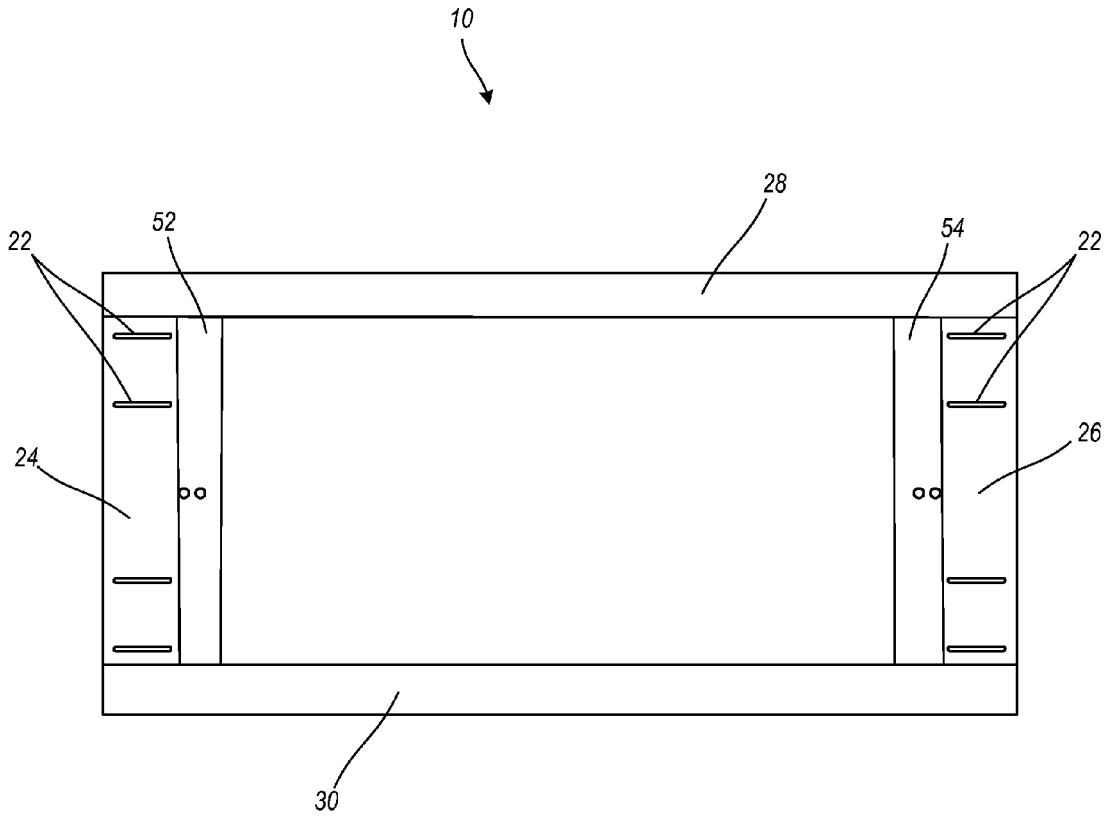
FIG. 9 is a top planar view of the crib rocker assembly depicted in FIG. 2, illustrated with the crib leg retention brackets removed.
Figure 10:
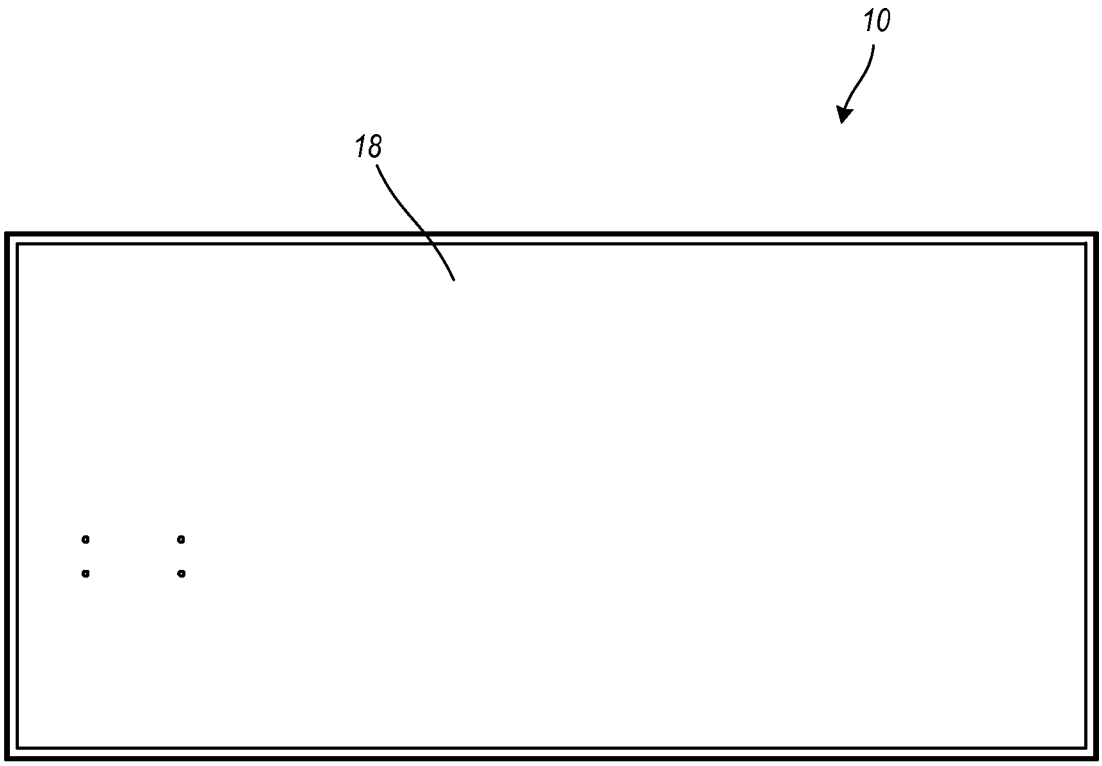
FIG. 10 is a bottom planar view of the crib rocker assembly depicted in FIG. 9.
Figure 11:
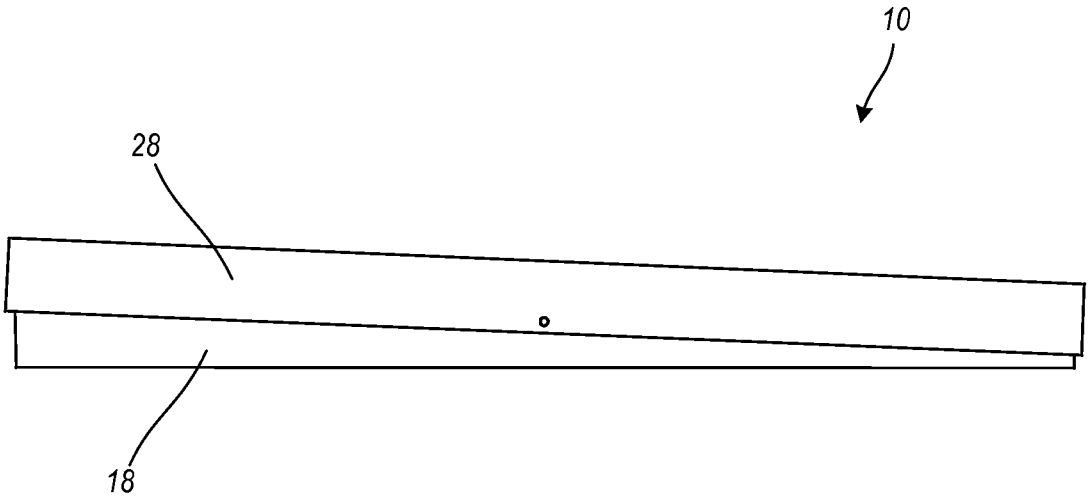
FIG. 11 is a right side planar view of the crib rocker assembly depicted in FIG. 9.
Figure 12:
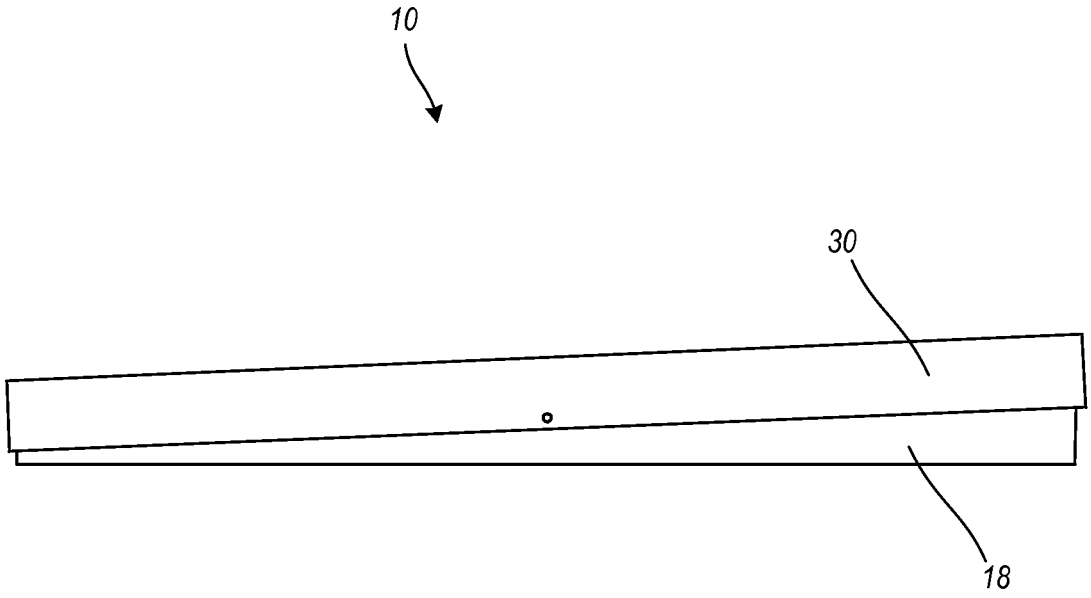
FIG. 12 is a left side planar view of the crib rocker assembly depicted in FIG. 9.
Figure 13:
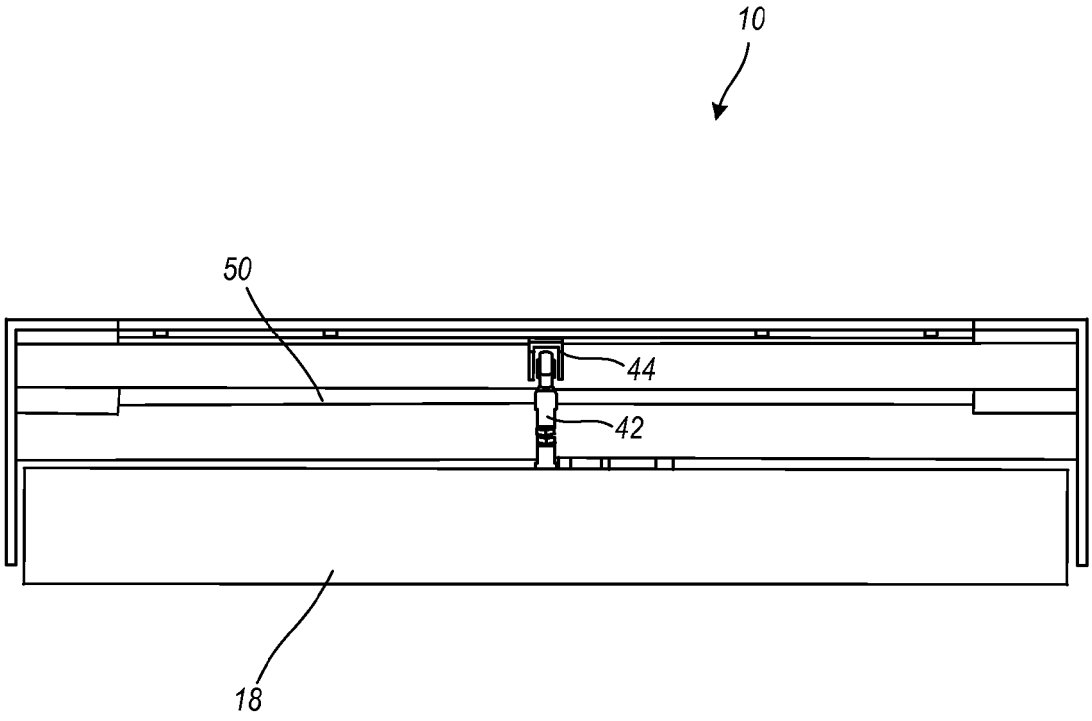
FIG. 13 is a rear planar view of the crib rocker assembly depicted in FIG. 9.
Figure 14:
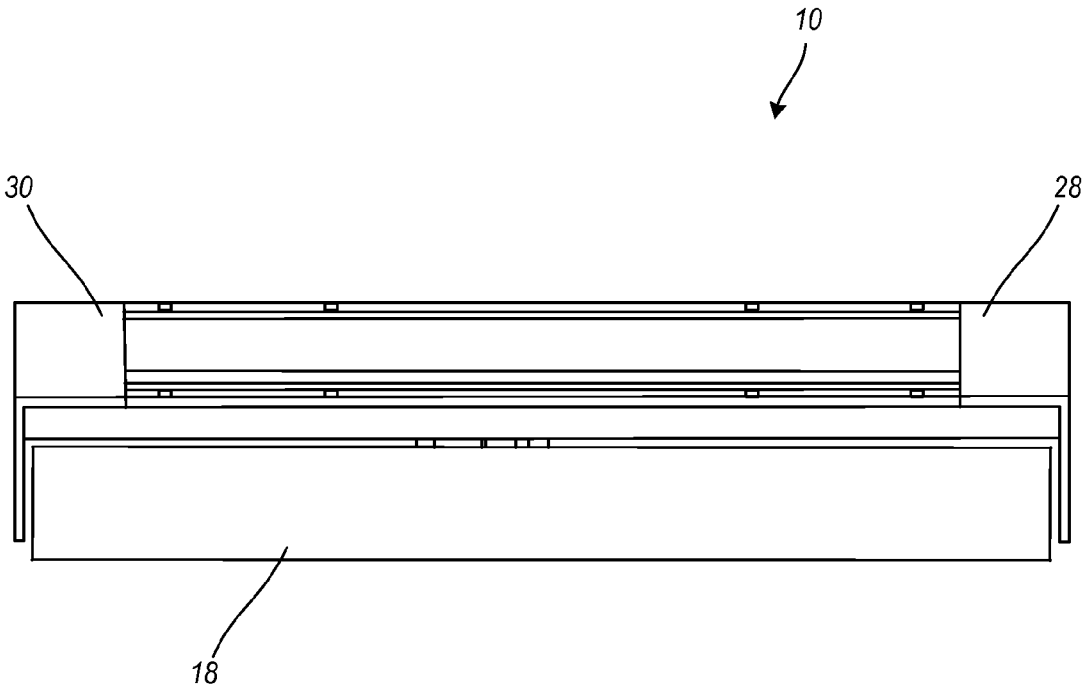
FIG. 14 is a front planar view of the crib rocker assembly depicted in FIG. 9.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a device, system, and associated methods to provide a reciprocatory movement to a crib, which is soothing and comforting to a baby. The device is used for reciprocating a crib to soothe the baby and help put the baby to sleep. The device comprises a self-contained unit on which a conventional crib can be positioned. The motorized baby crib support is configured to releasably secure to a conventional crib proper with four downwardly extending corner posts, two at the transverse ends thereof.

Referring now to the Figures, a crib support 10 is disclosed. The crib support 10 includes a frame assembly configured to receive a crib 12 and be releasably secured to the crib 12. The crib support 10 includes a rocking mechanism. The rocking mechanism is disposed within the frame assembly. The rocking mechanism is configured to provide a rocking motion to the crib 12 and to create the effect of a reciprocatory movement, which is soothing and comforting to a baby.

The frame assembly configured to receive a crib 12 and be releasably secured to the crib 12 further includes a bottom pan 18 and a top frame 20. The top frame 20 is configured to be placed upon the bottom pan 18. The rocking mechanism is affixed to the bottom pan 18 at one end and cooperates with the top frame 20 to raise and lower the corresponding end, thus rocking the crib 12 in an up and down motion.

The top frame 20 also includes a right side frame angle 28 and a left side frame angle 30. The right side frame angle 28 and the left side frame angle 30 are configured to provide additional structural support to the frame assembly and to provide a surface upon which a pivot means exists to provide a rocking motion to the releasably secured crib 12.

The top frame 20 further includes a first cross frame angle 24 and a second cross frame angle 26. The first cross frame angle 24 and the second cross frame angle 26 are configured to provide additional structural support to the frame assembly and to stabilize the right side frame angle 28 and the left side frame angle 30.

The top frame 20 still further includes a first frame plate 52 adjacent to the first cross frame angle 24 and a second frame plate 54 adjacent to the second cross frame angle 26. The first frame plate 52 and the second frame plate 54 are configured to provide additional structural support to the frame assembly and to stabilize the right side frame angle 28 and the left side frame angle 30.

The top frame 20 also includes a top cover 14 configured to be secured to the top frame 20 to conceal the rocking mechanism.

The bottom pan 18, top frame 20, right side frame angle 28, and left side frame angle 30 further include a multiplicity of pivot holes 46 configured to receive a pivot rod 50 about which the assembly pivots to provide a rocking motion and create the effect of a reciprocatory movement on the crib. The bottom pan 18, top frame 20, and side frames 28, 30 each have corresponding pivot holes 46.

The right side frame angle 28 and left side frame angle 28 further include a multiplicity of slots 22 disposed within a top surface to receive and secure crib leg retainers 16 in order to secure the legs of the crib 12.

The frame assembly configured to receive a crib 12 and be releasably secured to the crib 12 further includes a plurality of crib leg retainers 16 disposed upon the frame assembly and configured to receive and secure the legs of the crib 12.

The rocking mechanism further includes a motor mount assembly 32 and a pivot assembly 34. The motor mount assembly 32 is configured to provide a rocking motion and create the effect of a reciprocatory movement on the crib 12 about the pivot assembly 34.

The motor mount 32 assembly further includes a motor mount bracket 36 to attach the motor mount assembly 32 to the bottom pan 18 of the frame assembly, a motor 38 mounted to the motor mount bracket 36, a crank disk 40 attached to the motor 38, a link 42 attached to the crank disk 40, and a clevis bracket 44 attached to the link 42 and configured for coupled to the top frame 20.

The crib support 10 includes a power source (not shown) coupled to the motor to provide power to the motor to provide a rocking motion and create the effect of a reciprocatory movement on the crib about the pivot assembly.

The pivot assembly 34 includes a pivot rod 50 and a multiplicity of securing elements 48 to secure the pivot rod 50 to the frame assembly.

In another exemplary embodiment, a motorized baby crib system is provided. The motorized baby crib system includes a crib 12 for a baby and a crib support 10 having a frame assembly configured to receive the crib 12 and be releasably secured to the crib 12 and a rocking mechanism, disposed within the frame assembly, configured to provide a rocking motion, and configured to create the effect of a reciprocatory movement, which is soothing and comforting to a baby.

The motorized baby crib system also includes a multiplicity of crib leg retainers 16 disposed upon the frame assembly and configured to receive and secure the legs of the crib 12. The motorized baby crib system also includes a top cover 14 configured to be secured to the top frame 20 to conceal the rocking mechanism.

The frame assembly configured to receive a crib 12 and be releasably secured to the crib further includes a bottom pan 18 and a top frame 20 having a right side frame angle 28, a left side frame angle 30, a first cross frame angle 24, a second cross frame angle 26, a first frame plate 52 adjacent to the first cross frame angle 24, and a second frame plate 54 adjacent to the second cross frame angle 26. The top frame 20 is configured to be placed upon the bottom pan 18. The right side frame angle 28 and the left side frame angle 30 are configured to provide additional structural support to the frame assembly and to provide a surface upon which a pivot means exists to provide a rocking motion to the releasably secured crib 12. The first cross frame angle 24 and the second cross frame angle 26 are configured to provide additional structural support to the frame assembly and to stabilize the right side frame angle 28 and the left side frame angle 30. The first frame plate 52 and the second frame plate 54 are configured to provide additional structural support to the frame assembly and to stabilize the right side frame angle 28 and the left side frame angle 30.

The bottom pan 18, top frame 20, right side frame angle 28, and left side frame angle 30 further include a multiplicity of pivot holes 46 configured to receive a pivot rod 50 about which the assembly pivots to provide a rocking motion and create the effect of a reciprocatory movement on the crib 12.

The right side frame angle 28 and left side frame angle 30 further include a multiplicity of slots 22 disposed within a top surface to receive and secure crib leg retainers 16 in order to secure the legs of the crib 12.

In yet another exemplary embodiment, the technology described herein provides a method to provide a rocking motion to a crib 12 to create the effect of a reciprocatory movement, which is soothing and comforting to a baby. The method includes engaging a crib 12 to a crib support 10 comprising a frame assembly configured to receive a crib and be releasably secured to the crib 12; and a rocking mechanism, disposed within the frame assembly, configured to provide a rocking motion, and configured to create the effect of a reciprocatory movement, which is soothing and comforting to a baby and providing a rocking motion to the crib 12.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology described herein and are intended to be covered by the following claims.

What is claimed is:

1. A crib support comprising:

a frame assembly configured to receive a crib and be releasably secured to the crib;

a bottom pan defined within the frame assembly;

a top frame defined within the frame assembly, wherein the top frame is configured to be placed upon the bottom pan;

a right side frame angle defined within the top frame; and a left side frame angle defined within the top frame;

wherein the right side frame angle and the left side frame angle are configured to provide additional structural support to the frame assembly and to provide a surface upon which a pivot means exists to provide a rocking motion to the releasably secured crib;

a pivot rod disposed within a center portion of the bottom pan of the frame assembly and extended from the right side frame angle to the left side frame angle and adapted to provide an axis about which the frame assembly pivots;

a plurality of pivot holes adapted to receive the pivot rod and about which the assembly pivots to provide a rocking motion and create the effect of a reciprocatory movement on the crib; and a rocking mechanism, disposed within the frame assembly, configured to provide a rocking motion, and configured to create the effect of a reciprocatory movement, which is soothing and comforting to a baby;

wherein the rocking mechanism is affixed to the bottom pan at a first end and cooperates with the top frame to raise and lower a corresponding end, thus adapted to rock a crib in an up and down motion.

2. The crib support of claim 1, wherein the top frame further comprises:

a first cross frame angle; and a second cross frame angle;

wherein the first cross frame angle and the second cross frame angle are configured to provide additional structural support to the frame assembly and to stabilize the right side frame angle and the left side frame angle.

3. The crib support of claim 2, wherein the top frame further comprises:

a first frame plate adjacent to the first cross frame angle; and a second frame plate adjacent to the second cross frame angle;

wherein the first frame plate and the second frame plate are configured to provide additional structural support to the frame assembly and to stabilize the right side frame angle and the left side frame angle.

4. The crib support of claim 2, wherein the right side frame angle and left side frame angle further comprise:

a plurality of slots disposed within a top surface to receive and secure crib leg retainers in order to secure a leg of the crib.

5. The crib support of claim 1, further comprising:

a top cover configured to be secured to the top frame to conceal the rocking mechanism.

6. The crib support of claim 1, further comprising:

a plurality of crib leg retainers disposed upon the frame assembly and configured to receive and secure a crib leg.

7. The crib support of claim 1, wherein the rocking mechanism further comprises:

a motor mount assembly; and a pivot assembly;

wherein the motor mount assembly is configured to provide a rocking motion and create the effect of a reciprocatory movement on the crib about the pivot assembly.

8. The crib support of claim 7, wherein the motor mount assembly further comprises:

a motor mount bracket to attach the motor mount assembly to the bottom pan of the frame assembly;

a motor mounted to the motor mount bracket;

a crank disk attached to the motor;

a link attached to the crank disk;

a clevis bracket attached to the link and adapted to couple to the top frame.

9. The crib support of claim 8, further comprising:

a power source coupled to the motor to provide power to the motor to provide a rocking motion and create the effect of a reciprocatory movement on the crib about the pivot assembly.

10. A motorized baby crib system, the system comprising:

a crib for a baby; and a crib support having a frame assembly configured to receive the crib and be releasably secured to the crib a bottom pan defined within the frame assembly;

a top frame defined within the frame assembly, wherein the top frame is configured to be placed upon the bottom pan;

a right side frame angle defined within the top frame; and a left side frame angle defined within the top frame;

wherein the right side frame angle and the left side frame angle are configured to provide additional structural support to the frame assembly and to provide a surface upon which a pivot means exists to provide a rocking motion to the releasably secured crib;

a pivot rod disposed within a center portion of the bottom pan of the frame assembly and extended from the right side frame angle to the left side frame angle and adapted to provide an axis about which the frame assembly pivots;

a plurality of pivot holes adapted to receive the pivot rod and about which the assembly pivots to provide a rocking motion and create the effect of a reciprocatory movement on the crib; and a rocking mechanism, disposed within the frame assembly, configured to provide a rocking motion, and configured to create the effect of a reciprocatory movement, which is soothing and comforting to a baby;

wherein the rocking mechanism is affixed to the bottom pan at a first end and cooperates with the top frame to raise and lower a corresponding end, thus adapted to rock a crib in an up and down motion.

11. The motorized baby crib system of claim 10, further comprising:

a plurality of crib leg retainers disposed upon the frame assembly and configured to receive and secure a crib leg.

12. The motorized baby crib system of claim 10, further comprising:

a top cover configured to be secured to the top frame to conceal the rocking mechanism.

13. The motorized baby crib system of claim 10, wherein the frame assembly configured to receive a crib and be releasably secured to the crib further comprises:

a top frame having a right side frame angle, a left side frame angle, a first cross frame angle, a second cross frame angle, a first frame plate adjacent to the first cross frame angle, and a second frame plate adjacent to the second cross frame angle;

wherein the top frame is configured to be placed upon the bottom pan;

wherein the right side frame angle and the left side frame angle are configured to provide additional structural support to the frame assembly and to provide a surface upon which a pivot means exists to provide a rocking motion to the releasably secured crib;

wherein the first cross frame angle and the second cross frame angle are configured to provide additional structural support to the frame assembly and to stabilize the right side frame angle and the left side frame angle; and wherein the first frame plate and the second frame plate are configured to provide additional structural support to the frame assembly and to stabilize the right side frame angle and the left side frame angle.

14. The motorized baby crib system of claim 13, wherein the right side frame angle and left side frame angle further comprise:

a plurality of slots disposed within a top surface to receive and secure crib leg retainers in order to secure a leg of the crib.

* * * * *